US007390060B2

(12) United States Patent
Kristen

(10) Patent No.: US 7,390,060 B2
(45) Date of Patent: Jun. 24, 2008

(54) RECLINING CHAIR

(75) Inventor: Martin Kristen, Gelsenkirchen (DE)

(73) Assignee: Stanzwerk Wetter Sichelschmidt GmbH & Co. KG, Wetter (DE)

( * ) Notice: Subject to any disclaimer, the term of this patent is extended or adjusted under 35 U.S.C. 154(b) by 350 days.

(21) Appl. No.: 11/138,100

(22) Filed: May 26, 2005

(65) Prior Publication Data

US 2006/0225201 A1 Oct. 12, 2006

(30) Foreign Application Priority Data

Apr. 12, 2005 (DE) ..... 10 2005 016 943

(51) Int. Cl.
*A47C 1/035* (2006.01)
*A47C 17/04* (2006.01)

(52) U.S. Cl. ..... 297/343; 297/341

(58) Field of Classification Search ..... 297/341, 297/342, 343, 84; 5/12.1, 43
See application file for complete search history.

(56) References Cited

U.S. PATENT DOCUMENTS

| | | | | |
|---|---|---|---|---|
| 2,384,711 | A * | 9/1945 | Troendle | 297/342 |
| 3,042,935 | A | 7/1962 | Nielsen | |
| 3,202,453 | A * | 8/1965 | Richards | 296/66 |
| 3,548,877 | A | 12/1970 | Edwards | |
| 4,362,336 | A * | 12/1982 | Zapf et al. | 297/317 |
| 4,386,803 | A * | 6/1983 | Gilderbloom | 297/84 |
| 4,631,763 | A | 12/1986 | Singer | 5/149 |
| 6,059,364 | A * | 5/2000 | Dryburgh et al. | 297/354.13 |
| 6,247,753 | B1 * | 6/2001 | Alvestad | 297/362.13 |
| 6,641,214 | B2 * | 11/2003 | Veneruso | 297/322 |

FOREIGN PATENT DOCUMENTS

| | | |
|---|---|---|
| DE | 831009 | 2/1952 |
| DE | 9301415 | 4/1993 |
| DE | 29716669 | 12/1997 |
| FR | 2623067 | 5/1989 |
| GB | 894561 | 7/1959 |
| GB | 2275185 | 8/1994 |

* cited by examiner

*Primary Examiner*—Joseph F Edell
(74) *Attorney, Agent, or Firm*—Andrew Wilford

(57) ABSTRACT

A recliner has a frame having a pair of longitudinally extending and transversely spaced side beams having confronting inner faces and head and foot ends, a middle cushion on the frame between the ends thereof, a head cushion on the frame at the head ends, and a foot cushion on the frame at the foot ends. Respective head and foot hinges couple the middle cushion to the head and foot cushions for relative pivoting about respective transverse axes. A pair of transversely spaced followers on the middle cushion ride on respective longitudinally extending nonstraight guides on the side-beam inner faces. Supports, e.g. rollers, on the foot end of the frame slidably support the foot cushion thereon. Two rigid arms each have one end pivoted on a respective one of the side-beam head ends and an opposite end pivoted on the head cushion.

12 Claims, 3 Drawing Sheets

RECLINING CHAIR

FIELD OF THE INVENTION

The present invention relates to a recliner. More particularly this invention concerns a long reclining chair.

BACKGROUND OF THE INVENTION

A recliner typically comprises a generally horizontal frame on which are set a head cushion, a middle cushion, and a foot cushion. Mechanism allows the cushions to be shifted between a sitting position with the head cushion basically upright and the other two cushions flat, a tv-watching position with the head cushion raised and the two other cushions tipped to raise the user's knees, and a down or sleeping position with all the cushions basically horizontal.

The mechanisms that allow such recliners to move between and hold in their various positions are typically fairly complex. They are expensive to manufacture and assemble, and often provide locations where users can get pinched. In addition the mechanisms can fail or wear out.

OBJECTS OF THE INVENTION

It is therefore an object of the present invention to provide an improved recliner.

Another object is the provision of such an improved recliner that overcomes the above-given disadvantages, in particular that has a relatively simple operating mechanism so that it can be made cheaply and will have a long service life.

SUMMARY OF THE INVENTION

A recliner according to the invention has a frame having a pair of longitudinally extending and transversely spaced side beams having confronting inner faces and head and foot ends, a middle cushion on the frame between the ends thereof, a head cushion on the frame at the head ends, and a foot cushion on the frame at the foot ends. Respective head and foot hinges couple the middle cushion to the head and foot cushions for relative pivoting about respective transverse axes. A pair of transversely spaced followers on the middle cushion ride on respective longitudinally extending nonstraight guides on the side-beam inner faces. Supports, e.g. rollers, on the foot end of the frame slidably support the foot cushion thereon. Two rigid arms each have one end pivoted on a respective one of the side-beam head ends and an opposite end pivoted on the head cushion. The arms pivot between an up position with the head cushion generally upright and a down position with the head cushion generally horizontal. The head hinge is formed by a pair of rigid transversely spaced arms fixed on the head cushion and having front ends pivoted on the middle cushion.

The guiding of the middle cushion plus the arm mount of the head cushion and the hinging together of all three cushions makes the system operate very smoothly. The cushions move from the up position to the down position in a natural position shift controlled by simple mechanical elements.

According to the invention a spring engaged with the head cushion urges the head cushion into the up position. This spring can be a mechanical one, e.g. a coil tension spring, or a gas one. It facilitates return of the recliner to the up position, since movement in to the down position is typically done by a whole-body movement of the user. It also ensures that the recliner will stay in the up position unless intentionally moved into the down position. In fact the use of the knee-type linkage has the advantage that, when the spring is attached between the arms or links forming it, when the linkage is generally straight the spring is not effective to pull the recliner back up into the up position. Only when the link arms form an acute angle with each other does the spring have enough mechanical advantage to shift the cushions.

In accordance with the invention a drive shifts the cushions between the up and down positions. This drive includes a nut fixed on the middle cushion and a motor mounted on the frame and having an output formed as a longitudinally extending threaded spindle threaded into the nut. This spindle has a steep screwthread so as to be self-locking, that is so as to resist movement of the nut except when the motor is energized. This drive can be used primarily at the start when the recliner is being moved out of the up position, with further movement controlled manually by the user.

The guides according to the invention have head portions in which the respective followers are engaged in the up position and the guides extend downward and toward the foot end from the head portions. More particularly, the head portions are short and are horizontal. The guides further have foot portions in which the respective followers are engaged in the down position and the guides extend downward and toward the head end from the foot portions. They have central portions between the respective head and foot portions that are lower than the respective head and foot portions. These central portions are generally circularly arcuate and upwardly concave. The horizontal end portions are particularly advantageous in that they stably retain the followers and, when the followers are engaged in them, there is no tendency for the recliner position to change.

In order to raise the foot end of the middle cushion and the head end of the foot cushion in an intermediate position, the recliner further has respective longitudinally extending nonstraight second guides on the side-beam inner faces spaced toward the foot ends from the first-mentioned guides and a pair of transversely spaced second followers on the middle cushion riding on the respective second guides and spaced downstream from the first-mentioned followers. The second guides each have a horizontal head portion, a horizontal foot portion, and a central portion above the respective head and foot portions. The central portions of the second guides are centrally straight and level.

The first and second followers are spaced underneath the middle cushion. Thus they are out of the way and not likely to create a possibility of pinching or injury to the user.

The middle cushion projects transversely past the side beams and the side beams are cut out to accommodate the middle cushion in an intermediate position between the up and down positions. Thus the head end of the middle cushion can dip down in this intermediate position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
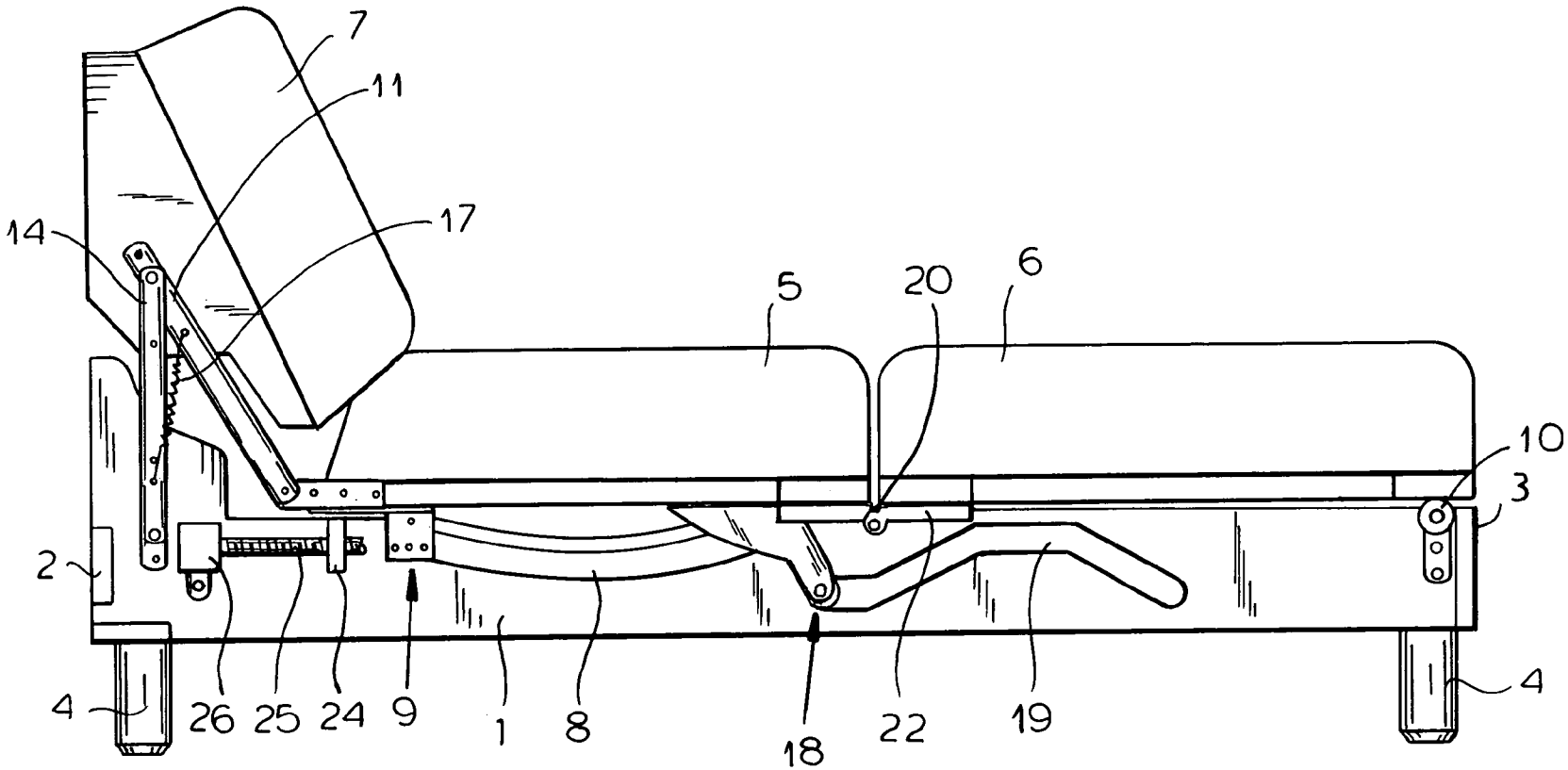
FIG. 1 is a schematic side view of the recliner according to the invention in the up or sitting position.

As seen in the drawing, the recliner according to the invention has a frame formed by a pair of side plates or beams 1 (only one shown) and a head board 2 and a foot board 3 at the head and foot ends of the beams 1. Feet 4 support the frame 1, 2, 3 on the floor. A middle cushion 5 on the frame 1, 2, 3 is flanked by a head cushion 7 and a foot cushion 6, each basically formed as a rigid rectangular panel supporting an upholstery-covered parallepipedal block of compressible foam. The cushions 5, 6, and 7 may project transversely past the beams 1, which are formed with cutouts 21 to accommodate dipping-down of the middle cushion 5 as will be described below.

The middle cushion 5 has a head end supported by a pair of followers 9 in respective guide grooves 8 in the inside faces of the beams 1 and a foot end supported by another pair of followers 18 in further respective guide grooves 19 formed also in the inside faces of the beams 1 and described in more detail below.

The foot cushion 6 has a head end secured by a hinge 22 for pivoting about a transverse axis 20 on the foot end of the cushion 5. In addition is rides on rollers 10 pivotal about an axis 23 parallel to the axis 20 on the foot ends of the frame beams 1.

The head cushion 7 is mounted on a pair of rigid arms or bars 11 having front ends projecting past the cushion 7 and secured to hinges 12 on the middle cushion 5 for pivoting about another transverse axis 13 parallel to the axes 22 and 23. Another pair of arms or bars 14 have upper ends pivoted at a transverse axis 15 on the bars 11 and lower ends pivoted at another transverse axis 16 on the head ends of the side beams 1. The arms 11 and 14 form a pair of knee linkages and each arm 11 is connected to the respective arm 14 by a coil spring 17 urging the linkages 11, 14 into the folded-together position of FIG. 1.

The guides 8 and 19 are formed as grooves or tracks in the inside faces of the side beams 1. The grooves 8 each have an upwardly open flattened U-shape with a short and horizontal head portion 8*a*, a circularly arcuate and upwardly concave middle portion 8*b*, and a short and horizontal foot portion 8*c*. The guides 19 each have a short and horizontal head portion 19*a*, a straight and rising portion 19*b* downstream from it, a horizontal and straight central portion 19*c*, and a straight and falling portion 19*d* downstream from it.

In addition as shown in FIG. 1, the head end of the middle cushion 5 has a dependent arm 24 formed as an internally threaded nut in which engages a threaded spindle 25 of a motor 26 mounted on the frame 1, 2, 3. Rotation of the spindle 24 therefore can longitudinally displace the cushion 5 on the frame 1, 2, 3.

The recliner operates as follows:

To start with as shown in FIG. 1 in the sitting position, the followers 9 and 18 are at the head ends 8*a* and 19*a* of their guides 8 and 19. The middle cushion 5 and foot cushion 6 are horizontal and basically coplanar. The head cushion 7 is generally upright, with the knee linkages formed by the arms 1 and 14 folded together.

Figure 2:
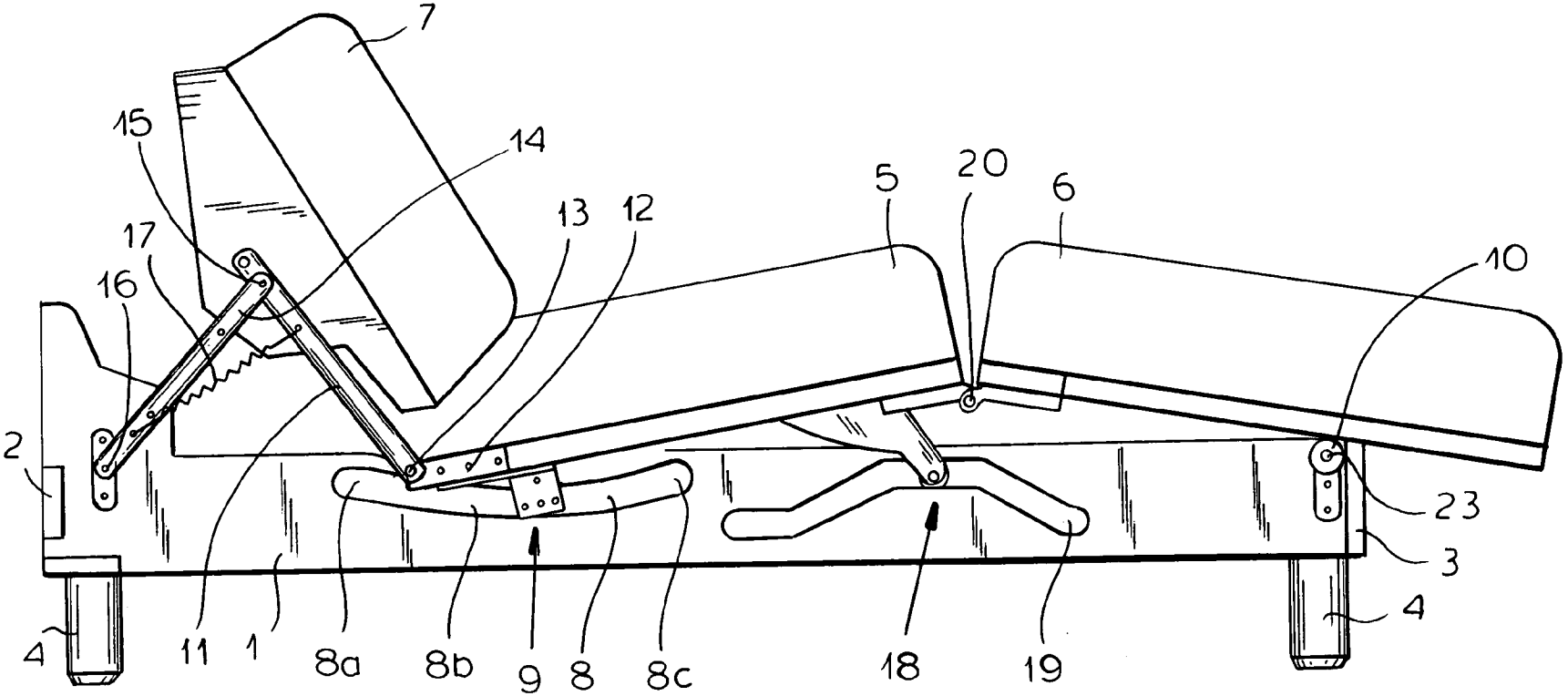
FIG. 2 is the recliner in the reclining or tv position.

The user can move the recliner from this position to the FIG. 2 reclining or tv position simply by pushing the foot cushion 6 forward while pushing the head end of the head cushion 7 back. This causes the linkages 11, 14 to open up, thereby shifting the cushion 7 forward while somewhat increasing the angle it forms with the vertical. The guides 9 ride down into the lowermost regions of the central portions 8*b* of the guides 8 so the head end of the cushion 5 dips downward, and the guides 18 ride up into the high central portions 19*c* of the guides 19 so the foot end of the cushion 5 rises. The cutouts 21 accommodate this movement. The foot cushion 6 rides forward on the rollers 10, and, since its head end is hinged to the raised foot end of the middle cushion 5, its head end rises and foot end drops.

Figure 3:
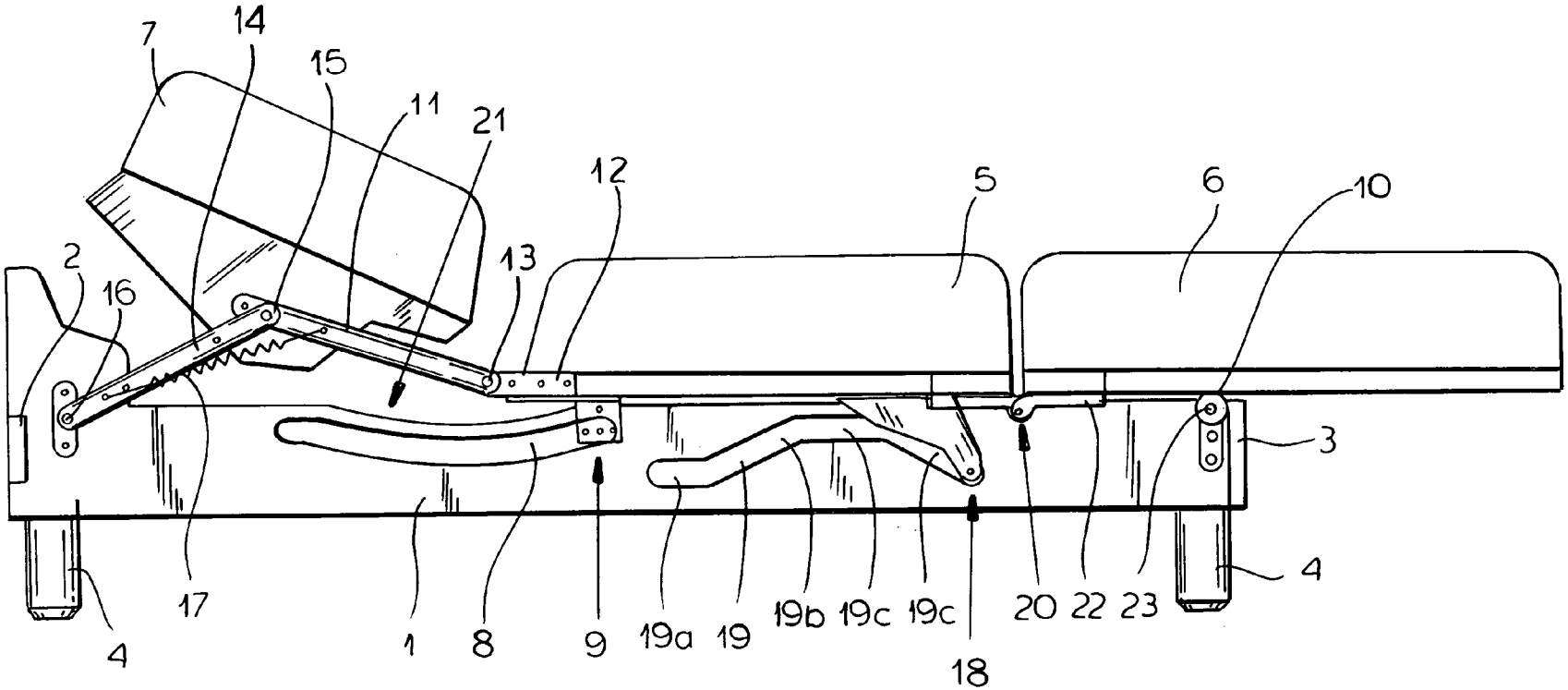
FIG. 3 is the recliner in the down or sleep position.

In the sleep or fully reclined position of FIG. 3 the linkages 11 and 14 are opened all the way up and the head cushion 7 is shifted forward into a more horizontal than vertical position. The guides 9 ride back up into the foot portions 8*c* of the guides 8, and the guides 18 ride down into the lower end of the foot portions 19*a* of the guides 19, so that both of the cushions 5 and 6 shift downstream into a horizontal position.

I claim:

1. A recliner comprising:

a frame having a pair of longitudinally extending and transversely spaced side beams having head and foot ends;

a middle cushion on the frame between the ends thereof;

a head cushion on the frame at the head ends;

a foot cushion on the frame at the foot ends;

respective head and foot hinges coupling the middle cushion to the head and foot cushions for relative pivoting about respective head and foot transverse axes;

respective longitudinally extending nonstraight head guides on the side beams and each having head and foot ends and a center below the respective head and foot ends;

respective longitudinally extending nonstraight foot guides on the side beams between the respective head guides and the foot ends of the beams;

respective transversely spaced head followers on the middle cushion, near the head hinge, and riding on the respective head guides for movement between respective head and rear end positions in the head and rear ends of the respective head guides and through a middle position with the head axis lower than in either of the respective end positions;

respective transversely spaced foot followers on the middle cushion, near the foot hinge, and riding on the respective foot guides for movement between respective head and foot end positions in the head and rear ends of the respective foot guides and through a middle position with the foot axis higher than in either of the respective end positions;

supports on the foot ends of the beams slidably supporting the foot cushion thereon; and a pair of rigid arms each having one end pivoted on a respective one of the side-beam head ends and an opposite end pivoted on the head cushion, the arms being pivotal to move the cushions between an up position with the head cushion generally upright, the middle and front cushions generally coplanar, and all the followers in the head ends of the respective guides, a down position with the head cushion generally horizontal and generally coplanar with the middle and front cushion and all the followers in the foot ends of the respective guides, and an intermediate position with the head cushion raised partially, the foot hinge raised. the head hinge depressed below the foot hinge, and the middle cushion extending downward toward the head ends of the beams.

2. The recliner defined in claim 1 wherein the head hinge is formed by a pair of rigid transversely spaced arms fixed on the head cushion and having foot ends pivoted on the middle cushion.

3. The recliner defined in claim 1, further comprising a spring engaged with the head cushion and urging the cushions into the up position.

4. The recliner defined in claim 1, further comprising drive means for shifting the cushions between the up and down positions and through the intermediate position.

5. The recliner defined in claim 4, wherein the drive means includes:

a nut fixed on the middle cushion; and a motor mounted on the frame and having an output formed as a longitudinally extending threaded spindle threaded into the nut.

6. The recliner defined in claim 5 wherein the spindle has a steep screwthread.

7. The recliner defined in claim 1 wherein the head guides have head portions that form the respective head ends and in which the respective followers are engaged in the up position and the head guides extend downward and toward the foot ends of the beams from the respective head portions.

8. The recliner defined in claim 7 wherein the head portions are short and are horizontal.

9. The recliner defined in claim 1 wherein head guides have the central portions that extend forward and downward from the respective head portions and that are generally circularly arcuate and upwardly concave.

10. The recliner defined in claim 1 wherein the foot guides each have a horizontal head portion;

a horizontal foot portion; and a central portion above the respective head and foot portions.

11. The recliner defined in claim 10 wherein the central portions of the foot guides are centrally straight and level.

12. The recliner defined in claim 1 wherein the head and foot followers are spaced underneath the middle cushion.

* * * * *